US009095178B1

(12) United States Patent
Mankaruse

(10) Patent No.: US 9,095,178 B1
(45) Date of Patent: Aug. 4, 2015

(54) SMART SURFING SUIT

(76) Inventor: Derrick Mankaruse, Huntington Beach, CA (US)

( * ) Notice: Subject to any disclaimer, the term of this patent is extended or adjusted under 35 U.S.C. 154(b) by 712 days.

(21) Appl. No.: 13/332,425

(22) Filed: Dec. 21, 2011

(51) Int. Cl.

| | |
|---|---|
| ***B63C 11/04*** | (2006.01) |
| ***B63C 11/10*** | (2006.01) |
| ***A41D 13/012*** | (2006.01) |
| ***A45F 3/16*** | (2006.01) |

(52) U.S. Cl.
CPC ..... *A41D 13/012* (2013.01); *A45F 3/16* (2013.01)

(58) Field of Classification Search
CPC ..... A62B 18/086; A42B 3/048; A63B 2225/682; A45F 3/16; A45F 2003/166; A45F 2200/0583
See application file for complete search history.

(56) References Cited

U.S. PATENT DOCUMENTS

| | | | | |
|---|---|---|---|---|
| 4,017,908 | A * | 4/1977 | Murnane | 2/114 |
| 4,090,650 | A * | 5/1978 | Gotta | 224/148.2 |
| 4,275,467 | A * | 6/1981 | Doelter | 2/82 |
| 4,494,246 | A * | 1/1985 | Tillbrook | 2/458 |
| 5,722,573 | A * | 3/1998 | Carnel | 224/148.2 |
| 5,864,880 | A * | 2/1999 | Adam | 2/94 |
| 6,108,970 | A * | 8/2000 | Ball | 47/48.5 |
| 6,434,749 | B1 * | 8/2002 | Grounds et al. | 2/2.15 |
| 6,749,090 | B2 * | 6/2004 | Bailey | 222/175 |
| 7,238,075 | B2 * | 7/2007 | Brodsky | 441/80 |
| 7,771,070 | B2 * | 8/2010 | Tarlton | 362/34 |
| 2002/0124294 | A1 * | 9/2002 | McKenzie et al. | 2/69 |
| 2006/0150292 | A1 * | 7/2006 | Roy | 2/2.15 |
| 2007/0101481 | A1 * | 5/2007 | Stokesbary | 2/211 |

FOREIGN PATENT DOCUMENTS

| | | | |
|---|---|---|---|
| WO | WO 9824335 | A1 * | 6/1998 |
| WO | WO 0128373 | A1 * | 4/2001 |
| WO | WO 2004019713 | A1 * | 3/2004 |

* cited by examiner

*Primary Examiner* — Alissa L Hoey
*Assistant Examiner* — Jameson Collier
(74) *Attorney, Agent, or Firm* — M. Ludwig

(57) ABSTRACT

A smart surfing suit includes an elastic garment which is impermeable to water, a reservoir to provide drinking fluid to a surfer via a flexible tube, protective pads, interior pockets, and exterior sealable pockets. The reservoir has internal vertical channels connected at the bottom by a horizontal channel. In an embodiment, light reflectors are attached to the garment to help identify the surfer in a rescue operation. In various embodiments, the suit covers the hands and legs of the surfer and is made of different colored materials.

9 Claims, 2 Drawing Sheets

SMART SURFING SUIT

CROSS-REFERENCE TO RELATED APPLICATION

None

TECHNICAL FIELD

The present invention relates generally to water sports gear, and more particularly to a surfing suit that provides various accommodations to a surfer.

SUMMARY OF THE INVENTION

It is a general object of the present invention to provide a highly innovative smart surfing suit made of an elastic material such as a fabric or polymer. The material is impermeable to sea water so that the surfer's body is sealed inside the smart surfing suit.

The smart surfing suit is constructed from an elastic material that can stretch and grip the body of the surfer with a reasonable force that the surfer can tolerate with comfort while wearing and during surfing.

The smart surfing suit is constructed like a garment that has a size to fit the body of the surfer that wears it. The smart surfing suit construction is made to cover all the body of the surfer including the hands and legs of surfer when wearing before getting into the ocean/sea.

The smart surfing suit is constructed to include interior and exterior pockets to secure personal items the surfer prefers to keep with him/her while surfing. The exterior pockets can be secured closed by a reusable sealing mechanism, such as for example a zipper or hook-and-loop fastener. The smart surfing suit has a reservoir located on the back side. The reservoir may be filled with a drinking fluid which the surfer may drink while surfing. A tube with a mouth piece on the proximal end supplies the drinking fluid to the surfer's mouth.

Pockets are provided in different garment models including pockets for keys, a wallet, or other personal items, and a pocket which seals when closed that is suitable for a mobile telephone.

In an embodiment, the garment includes colored materials. The colors may include shiny colors to help indicate the surfer's location for safety and help in a potential rescue operation.

In an embodiment, the smart surfing suit includes light reflectors attached to different parts of the suit to help identify the surfer in case of rescue operations.

DETAILED DESCRIPTION OF THE INVENTION

Figure 1:
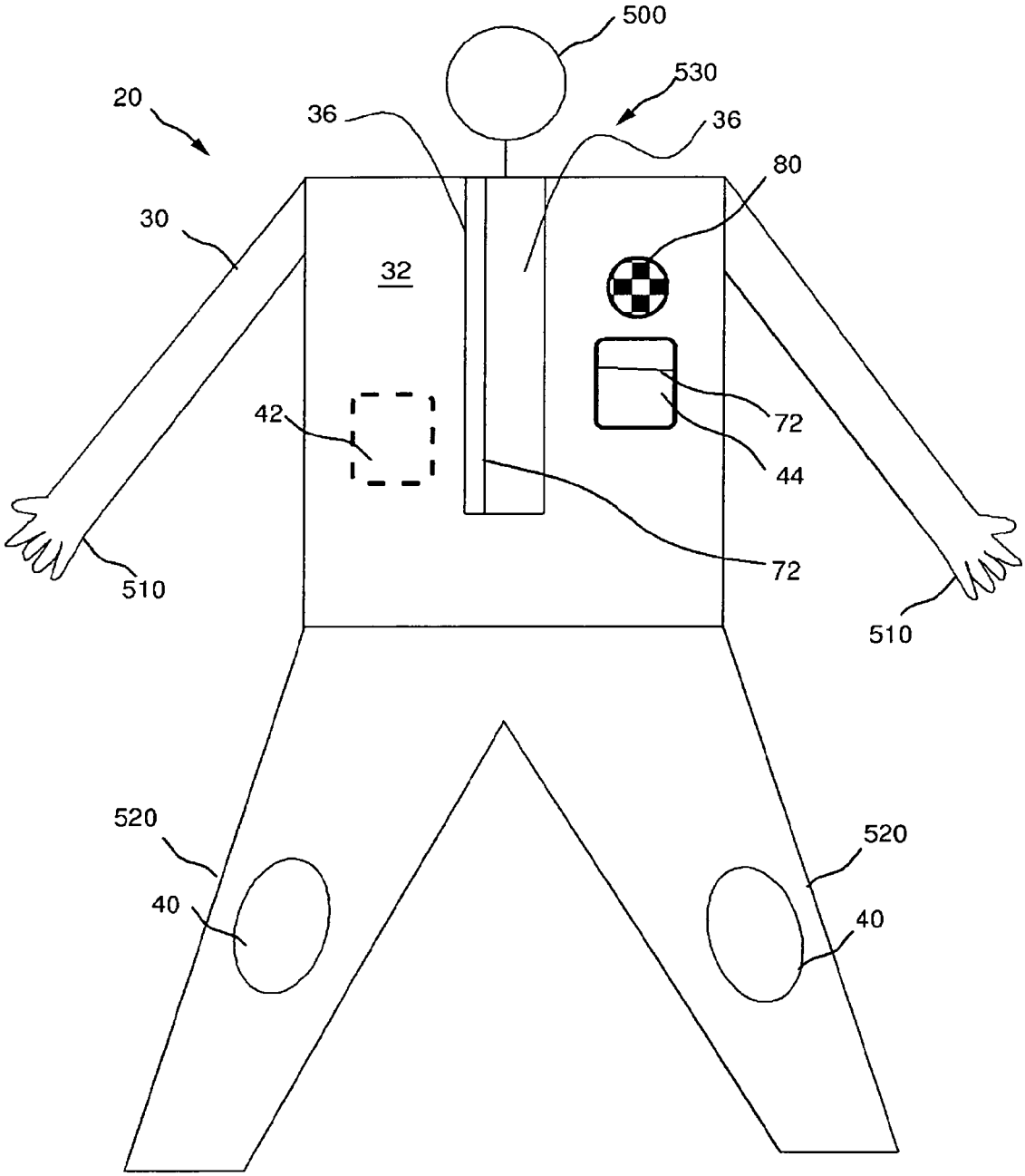
FIG. 1 is a front view of the smart surfing suit.
Figure 2:
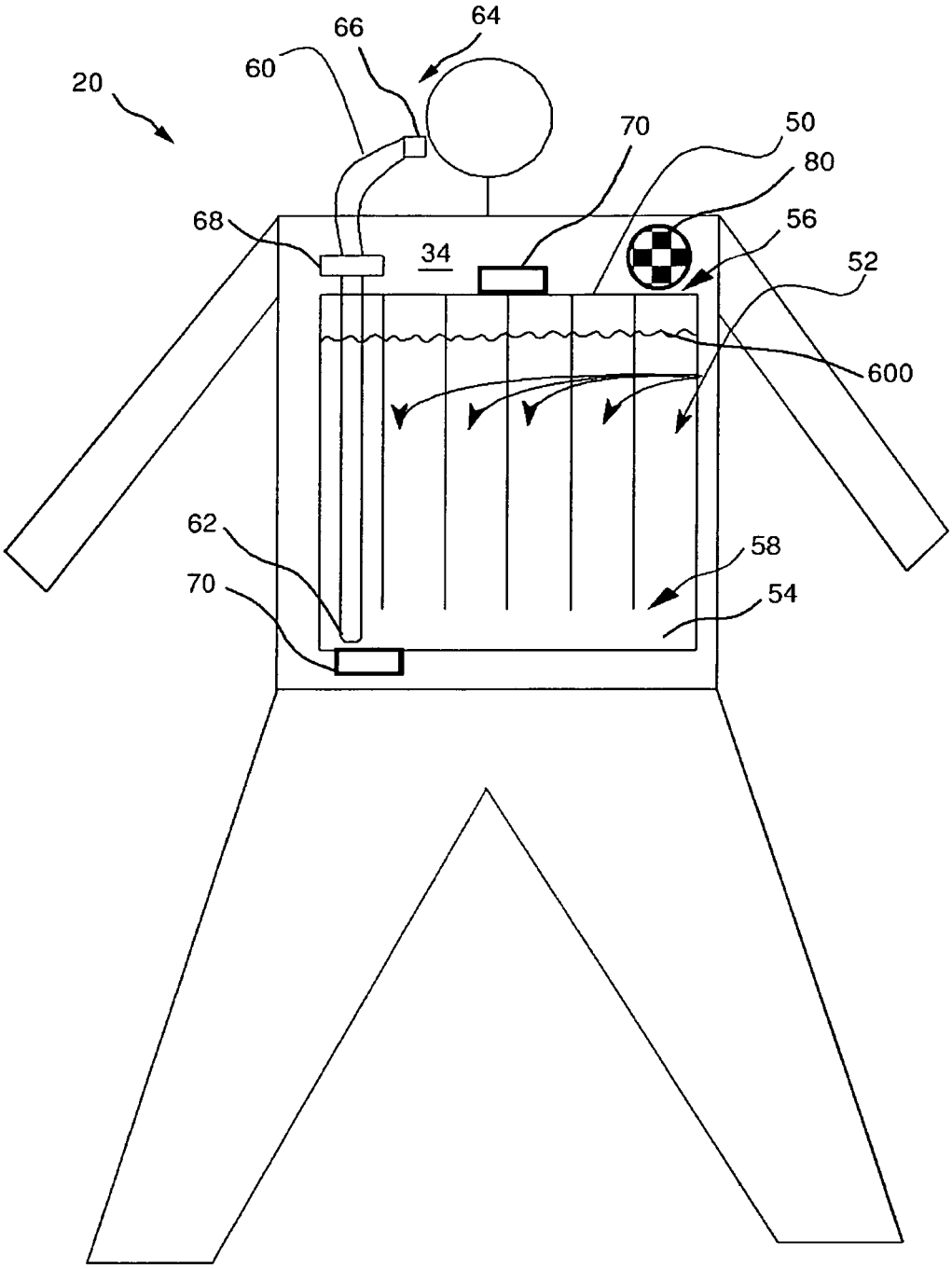
FIG. 2 is a back view of the smart surfing suit.

Referring to FIGS. 1 and 2, there are illustrated front and back views, respectively, of a smart surfing suit 20, which is a wetsuit that can supply amenities to a surfer 500 while surfing. Smart surfing suit 20 includes an elastic garment 30 which has a front side 32 and back side 34. When suit 20 is worn, front side 32 and back side 34 contact the chest and back of surfer 500, respectively.

The needs of a surfer while in the water riding the waves include sufficient drinking fluid to keep from getting thirsty while expending a large amount of energy. In the preferred embodiment, suit 20 allows the storage of a cooperating drinking fluid 600, such as water or any fluid used to quench thirst.

In the preferred embodiment, drinking fluid 600 may be stored in a reservoir 50, which is internally divided into a plurality of vertical channels 52. Reservoir 50 is preferably enclosed inside a pocket which is formed in the back side of garment 30 and sealed on four sides. The sealed pocket dimensions are preferably about 45 cm×50 cm with a thickness to accommodate the reservoir of 0.5 to 1.0 cm. This size of reservoir can provide between one to two liters (30 to 60 fluid ounces) of drinking fluid storage. The provided dimensions are optional depending on the garment size to fit the surfer and amount of fluid needed while surfing. Other factors to be considered include how much extra weight is optimum for the surfer to carry on his/her back while surfing and how long the surfer plans to stay in the water at a time.

Reservoir 50 further includes a bottom horizontal channel 54. Each vertical channel 52 has a bottom end 58 which is open to bottom horizontal channel 54. Each vertical channel 52 has a top end 56 which is closed to the top ends of adjacent vertical channels 52. In this manner vertical channels 52 are connected to each other at the bottom of reservoir 50 via bottom horizontal channel 54, which keeps the level of drinking fluid 600 equal in each vertical channel 52. In an embodiment, reservoir 20 has covered openings 70 which allow access to the inside of the reservoir for cleaning or flushing.

Suit 20 includes a tube 60, which has a distal end 62 and a proximal end 64. Tube 60 is used to supply drinking fcl luid 600 to the surfer on demand. Distal end 62 is disposed in reservoir 50. A mouthpiece 66 is connected to proximal end 64. A non-return valve 68 is disposed between distal end 62 and proximal end 64 of tube 60. In an embodiment, distal end 62 of tube 60 is rounded to reduce resistance to fluid uptake and reduce effort required for the surfer to drink.

Interior pockets 42 and exterior pockets 44 are provided in different embodiments including a pocket for keys, a pocket for a wallet, a pocket which is sealed when closed for a mobile telephone, and extra pockets if needed for other items that the surfer might think of taking with him while surfing and have no desire to leave in his car or elsewhere. Exterior pockets 44 can be secured closed by a reusable sealing mechanism 72, such as for example a zipper or hook-and-loop fastener. The smart surfing suit is designed from a light weight material that is impermeable to salt water (i.e., having pores that salt water cannot penetrate). The material used may be polyurethane, polyester, or any other material with suitable characteristics to fulfill the requirement of impermeability to salt water.

Materials suitable for garment 30 are easily formed by molding or other manufacturing operation to reduce production cost and provide the best qualities. Pads 40 are located on garment 30 to protect the surfer from injury and provide comfort.

In an embodiment, when suit 20 is worn by surfer 500, garment 30 covers the hands 510 and legs 520 of surfer 500. In another embodiment, garment 30 has two folding sides 36 which allow the surfer to easily slip their body 530 inside suit 20. Folding sides 36 may be connectable by a reusable sealing mechanism 72, which keeps water from getting inside garment 30 and wetting the chest of the surfer.

Other pockets may be made accessible by the hand of the surfer from the outside of the garment when worn. Other pockets can be accessible from the inside of the garment for added protection from leaks. Such interior pockets may be on any side of the surfer, such as under the arm, and would be suitable to store a mobile phone. A padded pocked is preferred to offer resistance to damage from shocks.

Different colored materials are used in various embodiments. The colors may include shiny colors to help indicate the surfer location for safety and help in rescue operation in case of danger to the surfer.

The smart surfing suit includes attached light reflectors 80 on different parts to help identify the surfer in case of rescue operations.

What is claimed is:

1. A smart surfing suit for a surfer to wear, the suit comprising:

an elastic garment having a front side and a back side, said garment being impermeable to water;

pads located on said garment to protect the surfer from accidents and to provide comfort;

said garment having interior and exterior pockets, at least one said exterior pocket being securedly closeable;

a reservoir affixed to said back side of said garment, said reservoir configured to be filled with a drinking fluid;

said reservoir internally divided into a plurality of vertical channels and one bottom horizontal channel, each said vertical channel having a top end and a bottom end, each said bottom end being open to said bottom horizontal channel and each said top end being closed to said top ends of adjacent said vertical channels;

a tube having a distal end and a proximal end, said distal end disposed in said reservoir, and a mouth piece connected to said proximal end; and, a non-return valve disposed between said distal end and said proximal end of said tube.

2. The smart surfing suit of claim 1, the surfer having hands and legs, the suit further including:

said garment covering the hands and legs when the suit is worn by the surfer.

3. The smart surfing suit of claim 1 wherein said reservoir has covered openings for accessing the inside of said reservoir to clean said reservoir by flushing.

4. The smart surfing suit of claim 1 wherein said at least one exterior pocket is securedly closeable by a reusable sealing mechanism.

5. The smart surfing suit of claim 1, the surfer having a body, the suit further including:

said front side of said garment having two folding sides to allow the surfer to easily slip the body inside the suit.

6. The smart surfing suit of claim 5 wherein said two folding sides are connectable by a reusable sealing mechanism.

7. The smart surfing suit of claim 1 wherein said garment includes materials of different colors.

8. The smart surfing suit of claim 1, further including:

light reflectors attached to said garment for identifying the surfer in case of rescue operations.

9. The smart surfing suit of claim 1 wherein said distal end of said tube is rounded to reduce resistance to fluid uptake and reduce suction effort required by the surfer.

* * * * *